US006855028B2

(12) United States Patent
Siegel

(10) Patent No.: US 6,855,028 B2
(45) Date of Patent: Feb. 15, 2005

(54) REMOTELY CONTROLLED STEERABLE BALL

(75) Inventor: Robert Paul Siegel, Penfield, NY (US)

(73) Assignee: Robert P Siegel, Rochester, NY (US)

( * ) Notice: Subject to any disclaimer, the term of this patent is extended or adjusted under 35 U.S.C. 154(b) by 0 days.

(21) Appl. No.: 10/402,725

(22) Filed: Mar. 29, 2003

(65) Prior Publication Data

US 2004/0192163 A1 Sep. 30, 2004

(51) Int. Cl.[7] ..... A63H 33/00
(52) U.S. Cl. ..... 446/486; 446/456
(58) Field of Search ..... 446/486, 456

(56) References Cited

U.S. PATENT DOCUMENTS 3,101,569 A 8/1963 Giardina
4,194,737 A * 3/1980 Farmer ..... 473/570
4,501,569 A * 2/1985 Clark et al. ..... 446/458
4,541,814 A * 9/1985 Martin ..... 446/456
4,601,675 A * 7/1986 Robinson ..... 446/449
4,927,401 A * 5/1990 Sonesson ..... 446/456
5,113,842 A * 5/1992 Moormann ..... 124/65
5,297,981 A * 3/1994 Maxim et al. ..... 446/437
5,377,655 A * 1/1995 Arad ..... 124/65
5,439,408 A * 8/1995 Wilkinson ..... 446/409
5,533,921 A 7/1996 Wilkinson
5,924,909 A * 7/1999 Yamakawa ..... 446/442
5,964,639 A * 10/1999 Maxim ..... 446/437
6,414,457 B1 * 7/2002 Agrawal et al. ..... 318/568.12
6,458,008 B1 * 10/2002 Hyneman ..... 446/259

FOREIGN PATENT DOCUMENTS

GB 2197215 A * 5/1988 ..... F41B/7/08

* cited by examiner

*Primary Examiner*—Derris H. Banks
*Assistant Examiner*—Ali Abdelwahed

(57) ABSTRACT

An amusement device of a projectile nature that can be thrown or flung or propelled through the air by a launcher includes the characteristic that it can be induced through an electo-mechanical device that deploys articulatable aerodynamic members that cause it to spin in such a way as, to change it's trajectory in mid-flight in response to a signal generated from a remote control device.

6 Claims, 3 Drawing Sheets

REMOTELY CONTROLLED STEERABLE BALL

BACKGROUND OF THE INVENTION

1. Field of the Invention

This invention relates generally to amusement devices and, in particular, to a new and improved toy in the form of a ball that can be induced to change its trajectory in mid-flight in response to a signal from a remote controlled device.

2. Description of Related Art

Toys that are remotely controlled have been known heretofore in the art. For example, U.S. Pat. No. 3,101,569 to Giardina and U.S. Pat. No. 5,533,921 to Wilkinson represent the closest prior art to the subject matter of the instant invention of which the applicant is aware.

The patent to Giardina discloses a remote control toy vehicle comprising a remote wheeled vehicle having a body configured in the shape of an airplane steering wheel for controlling movement of the remote toy airplane across a supporting surface. The rear wheels of the vehicle are driven by a reversible electric motor while the front wheels are normally free spinning. Steering of the vehicle is accomplished by applying friction to one or the other of the front wheels to prevent rotation thereof. Friction is applied to the wheels by respective solenoid assemblies that are independently actuable. The drive motor and solenoids are controlled by switches on the hand controller. More specifically, forward and rearward movement, i.e., energizing of the drive motor, is controlled by independent push buttons on the hand controller. Actuation of the solenoids is controlled by a tilt switch mounted in the hand controller and comprising a rolling ball mounted inside a housing having internal contacts. Turning of the hand controller effects rolling of the ball and closure of the respective contacts for energizing the corresponding solenoid. Accordingly, rotation of the simulated steering wheel in a vertical plane effects turning of the toy airplane.

The patent to Wilkinson discloses a remote controlled movable ball amusement device that includes a hollow sphere having two propulsion mechanisms within the sphere, with each mechanism driven on a separate track. The drive unit causes the sphere to move when actuated by the receiver. A remote transmitter sends signals to the receiver for causing the actuation of the drive unit.

While the above-described remote controlled toy devices are effective for their intended purpose, there is nevertheless a continuing need, and a consumer desire, for remote controlled devices having improved movement effects and configurations to enhance the play value of such toys.

SUMMARY OF THE INVENTION

Accordingly, pursuant to the features of the present invention, an improved toy is disclosed in the form of a ball that can be thrown like an ordinary ball, except that the trajectory of the ball can be changed in mid-flight by a signal from a remote device. A ball launcher with an integrated remote control is included to provide propulsion to the ball, if desired.

This and other features and advantages of the invention are described in or apparent from the following detailed description of the exemplary embodiments.

BRIEF DESCRIPTION OF THE DRAWINGS

The foregoing and other features of the instant invention will be apparent and easily understood from a further reading of the specification, claims and by reference to the accompanying drawings in which like reference numerals refer to like elements and wherein:

DETAILED DESCRIPTION OF THE INVENTION

While the present invention will be described in connection with preferred embodiments thereof, it will be understood that it is not intended to limit the invention to those embodiments. On the contrary, it is intended to cover all alternatives, modifications, and equivalents as may be included within the spirit and scope of the invention as defined by the appended claims.

Figure 1:
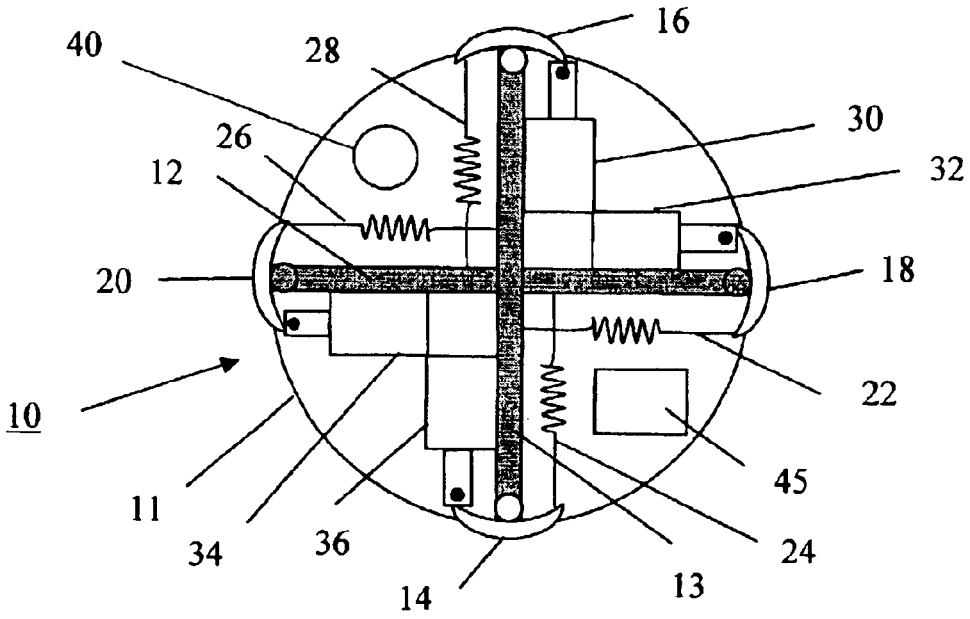
FIG. 1 is a schematic plan view of a ball of the present invention showing external aerodynamic features used to control the trajectory of the ball.
Figure 2:
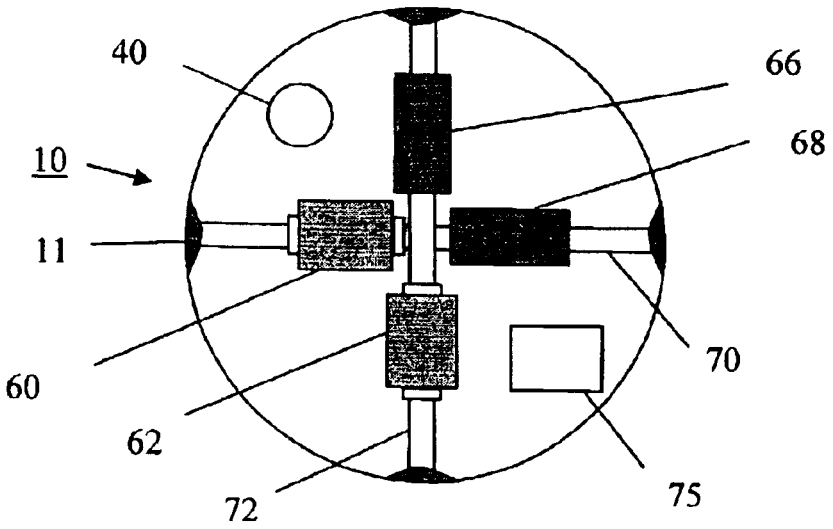
FIG. 2 is a schematic plan view of a second embodiment of the ball of FIG. 1 showing the internal inertial structure that controls the trajectory of the ball.

For a general understanding of the features of the present invention, reference is made to the drawings. In the drawings, like reference numerals have been used throughout to identify identical elements. FIGS. 1 and 2 schematically depict plan views illustrating a ball incorporating the features of the present invention therein. It will become evident from the following discussion that the steerable ball of the present invention may be employed in a wide variety of amusement activities and is not specifically limited in its application to the particular system and method specifically mentioned herein.

Referring now to FIGS. 1–4, various views are shown illustrating a remotely controlled steerable ball that is used in accordance with the present invention for amusement purposes. The primary mechanism for affecting the trajectory of the ball is through the same mechanism that produces a curveball. A ball is thrown with a significant amount of spin. The vortex that surrounds the ball as it spins through the air creates a pressure differential. The pressure differential exerts a force on the spinning ball, which accelerates the ball in a direction perpendicular to the axis of rotation. There are two primary methods for generating spin in a flying ball. These are (1) internal-inertial and (2) external aerodynamic.

In FIG. 1, a schematic representation of a remotely controlled steerable ball 10 is shown that employs the external-aerodynamic method for generating spin of ball 10.

Ball 10 comprises a cover 11, inside of which are supports 12 and 13 that support articulatable aerodynamic members 14, 16, 18, and 20 on ends thereof. The articulatable members 14, 16, 18 and 20 pivot on supports 12 and 13 and are biased in a predetermined direction by springs 22, 24, 26 and 28 that are connected to one end thereof. Solenoids 30, 32, 34 and 36 powered by battery 40 are connected through their plungers to the other end of the members such that actuation of the solenoids will cause the plungers to pivot the members about their connection to supports 12 and 13. Alternative linear actuators, such as, motors with appropriate gearing or shape memory alloy wires could also be used instead of the solenoids. A control circuit for the ball is shown at 45. In action, the shape changing features of members 14, 16, 18 and 20 are deployed that enhances both the spin and the strength of the vortex. These features are deployed by means of the electromechanical actuators or solenoids 30, 32, 34 and 36 that either raise members 14, 16, 18 and 20 or openings in the surface of ball 10 that provide the desired effect. Other appropriate actuating means, such as, shape-memory-alloy wires, motor-screw drive mechanisms, linear motors, linear actuators or rotary actuators with cams could be used, if desired.

An internal-inertial method and apparatus for curving a thrown ball 10 is shown in FIG. 2 where an apparatus inside the ball causes the ball to spin without changing the ball's exterior shape. The apparatus inside the ball comprises a pair of shaft mounted motors 60 and 82 that are adapted to move balance weights or masses 88 and 68, respectively, along shafts 70 and 72. Care should be taken to ensure that the rotor of each motor has a higher inertia than the ball cover 11. This will ensure that the ball surface will spin. A control circuit 75 is included for providing signals to the motors. Actuation of motors 60 and 62 will cause masses 66 and 68 to rotate resulting in rotation of the ball in flight, which will then cause the ball to curve as it moves through the air.

Figure 3:
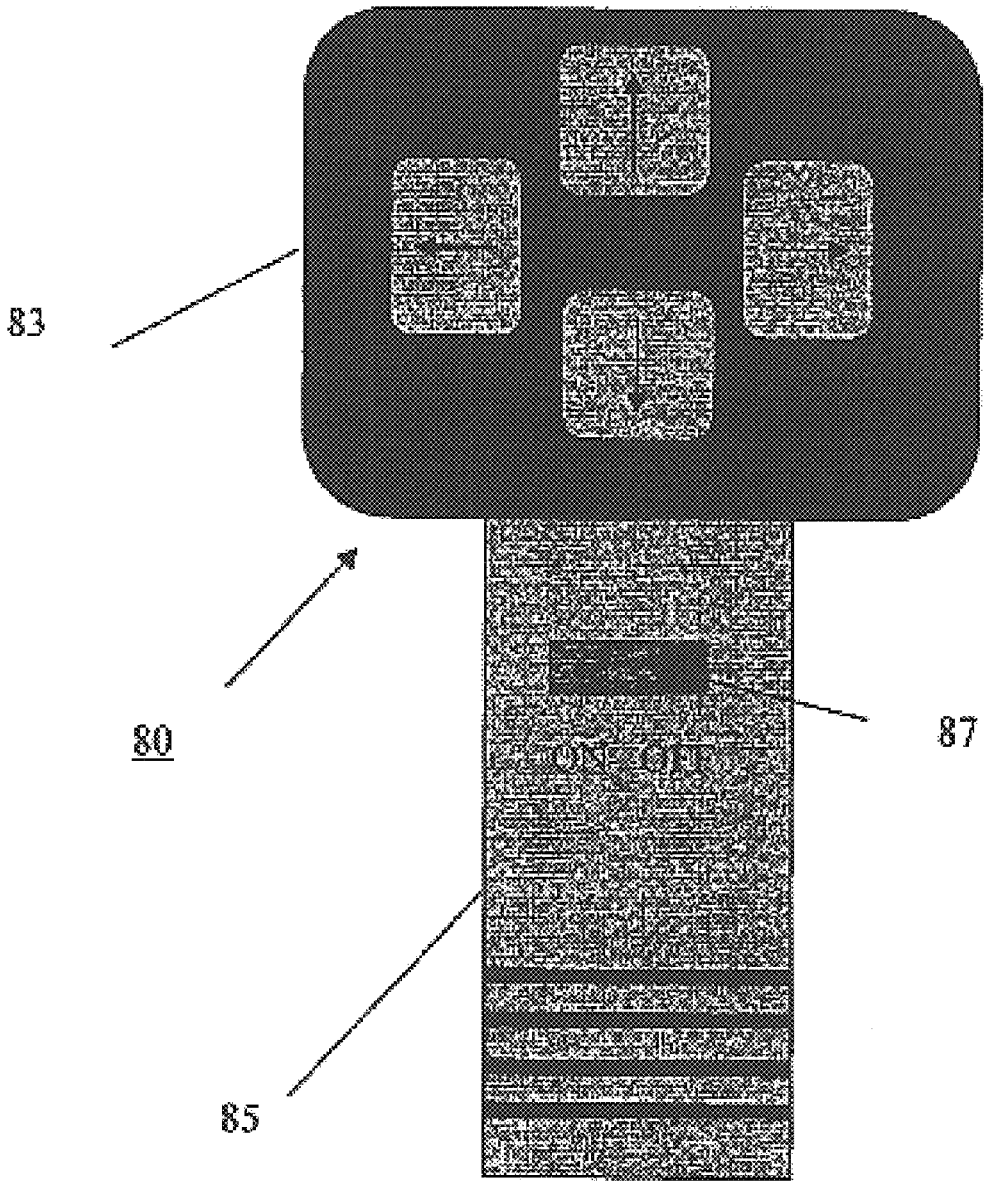
FIG. 3 is a schematic plan view of a remote controller for the balls of FIGS. 1 and 2.

A remote controller 80 is shown in FIG. 3 is adapted to control the mechanisms in ball 10 and includes a control panel 83 connected to a handle 85 that has an ON/OFF switch mechanism 87 mounted thereon. When switch 87 is in the ON position, manipulation of directional buttons on the control panel through control circuits in the ball signals the motors and solenoids in ball 10 to actuate members that affect curvature of the ball in accordance with the arrows shown on the control panel.

Figure 4:
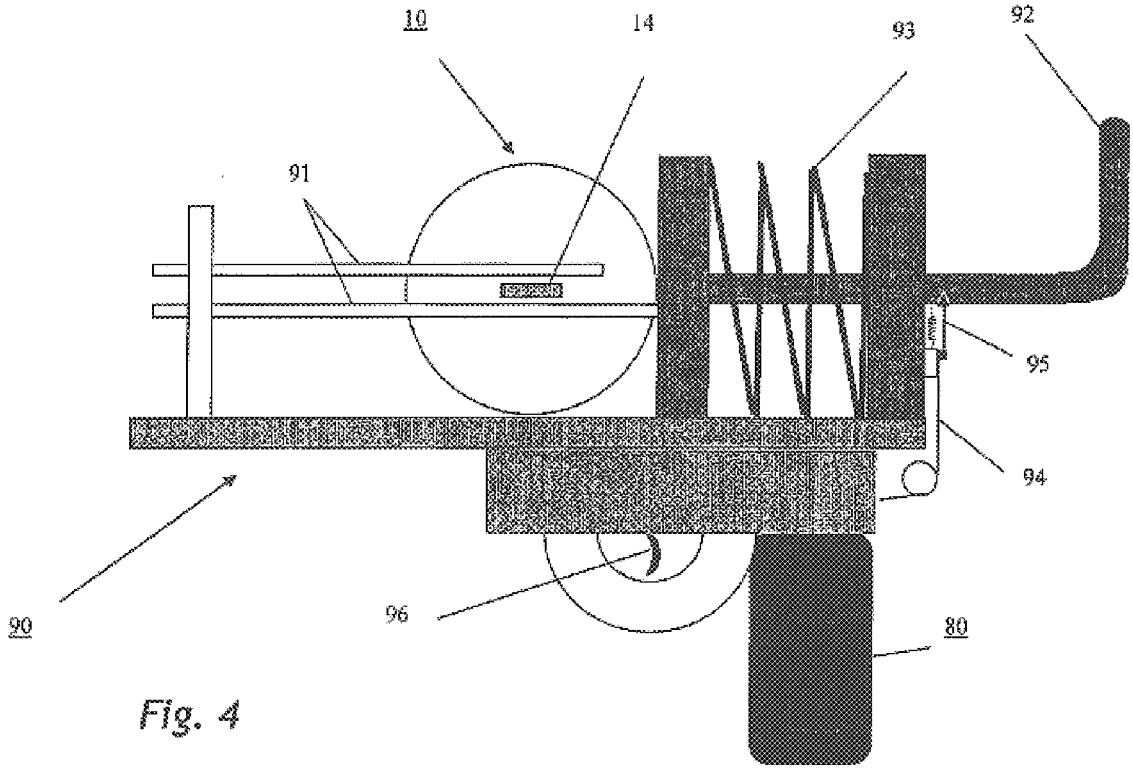
FIG. 4 is a schematic plan view of a ball launcher with an integrated remote controller.

FIG. 4 shows a ball launcher with an integrated remote controller. This is an extension to the basic idea, which provides several additional features. The launcher can effectively impart higher velocity to the ball, which will result in a longer distance and greater travel time than what can typically be achieved by a simple throwing action. This greater travel time will provide for greater enjoyment of the remote control steering feature. Additionally, the launcher can provide an initial orientation of the ball, which will improve the performance of the electronic steering system.

A ball launcher with integrated remote controller 90 is shown in FIG. 4. The ball is placed between the alignment rails 91 that along with articulatable members 14 fix the ball's initial orientation. A power spring 93 is compressed by means of retraction lever 92, which provides the motive force to launch the ball 10. The retraction lever 92 is latched by the lever release 95 which remains in place until the trigger 96 is pulled, which provides sufficient tension into the release cable 94 to slide the lever release 95 free and allow the retraction lever 92 to move, releasing the power spring 93 and launching the ball 10. The integrated remote control 80, which serves as a handle during the launch phase, is then used to steer the ball 10, once it is airborne.

It should now be understood that a simple, low cost, remote controlled ball has been disclosed that can be thrown like an ordinary ball, except that the trajectory of the ball can be changed in mid-flight by a signal from a remote device. The ball can be simply thrown or launched by means of a ball launcher.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. A remote controlled ball amusement device adapted to aerodynamic change trajectory in mid-flight as it is propelled through air, including:

a sphere, said sphere being hollow and having an outer surface;

a plurality of articulatable aerodynamic members positioned to extend above said outer surface of said sphere;

a plurality of actuators pivotally connected to said articulatable aerodynamic members;

a control circuit; and a wireless remote control device adapted through said control circuit to actuate said actuators while said sphere is in mid-flight which in turn moves said articulatable aerodynamic members into an open position to thereby induce sufficient spin to change mid-flight trajectory of said sphere.

2. The remote controlled ball amusement device of claim 1, wherein said plurality of actuators comprise solenoids.

3. The remote controlled ball amusement device of claim 2, wherein said plurality of articulatable aerodynamic members are biased into a closed position.

4. The remote controlled ball amusement device of claim 3, wherein said plurality of articulatable aerodynamic members are biased into said closed position by springs.

5. The remote controlled ball amusement device of claim 1, wherein said device includes a battery.

6. The remote controlled ball amusement device of claim 1, including a ball launcher to provide propulsion to said ball amusement device.

* * * * *